United States Patent [19]

Buysman

[11] 4,011,123

[45] Mar. 8, 1977

[54] APPARATUS FOR ETCHING A CONTINUOUSLY MOVING THIN METAL STRIP

[75] Inventor: Petrus Johannes Buysman, Eindhoven, Netherlands

[73] Assignee: U.S. Philips Corporation, New York, N.Y.

[22] Filed: Oct. 30, 1975

[21] Appl. No.: 627,105

[30] Foreign Application Priority Data

Jan. 9, 1975 Netherlands ..... 7500246

[52] U.S. Cl. ..... 156/345; 134/122 R; 134/151; 134/198; 156/640

[51] Int. Cl.[2] ..... C23F 1/02

[58] Field of Search ..... 156/7, 8, 16, 345; 134/15, 64, 122 R, 137, 143, 146, 151, 198

[56] References Cited

UNITED STATES PATENTS

| | | | |
|---|---|---|---|
| 2,777,088 | 1/1957 | Lafferty | 315/21 |
| 3,082,774 | 3/1963 | Benton et al. | 134/63 |
| 3,679,500 | 7/1972 | Kubo et al. | 156/11 |
| 3,830,677 | 8/1974 | Paulin | 156/345 |

*Primary Examiner*—William A. Powell
*Attorney, Agent, or Firm*—Frank R. Trifari; George B. Berka

[57] ABSTRACT

An apparatus for etching a continuously moving thin metal strip in which the length of the etching compartment is adjustable to adapt the etching duration to the thickness of the strip. The length is adjustable by means of a movable housing which comprises closure means through which the strip enters or leaves the etching compartment.

3 Claims, 2 Drawing Figures

APPARATUS FOR ETCHING A CONTINUOUSLY MOVING THIN METAL STRIP

The invention relates to an apparatus for etching a continuously moving thin metal strip, comprising an etching compartment in which spraying heads for etching liquid are arranged along the length of the etching compartment, which compartment is closed on the inlet end and on the outlet end by means of closure means pressing against both main surfaces of the strip.

Such an apparatus is known and is used, for example, for etching apertures in metal foils used for the manufacture of a shadow mask for a display tube for colour television. In the present-day display tubes the pitch between the apertures is so small that the etching duration must be very accurately controlled to obtain the correct shape of the apertures. However, the etching duration depends on the thickness of the strip. Since in such an etching apparatus the speed of the strip is also determined by other terminals to which the strip is subjected, it is hardly possible to vary the etching duration by varying the speed of the strip. The etching process cannot be controlled sufficiently accurately by turning on and turning off the supply of etching liquid to the spraying heads.

It is the object of the invention to provide an etching apparatus in which the etching duration can be adjusted accurately and continuously.

According to the invention, an apparatus of the kind defined in the first paragraph is characterized in that the said closure means on at least one of the two ends is arranged in a housing which is provided so as to be movable in the etching compartment, the housing being sealed on the outside relative to the etching compartment. Such a movable housing is preferably present on the inlet end of the etching compartment and hence determines accurately the instant at which the strip is first hit by etching liquid, so that the etching duration is accurately fixed. According as the strip is thinner, the housing is moved further into the etching compartment since in that case the required etching duration is shorter.

Figure 1:
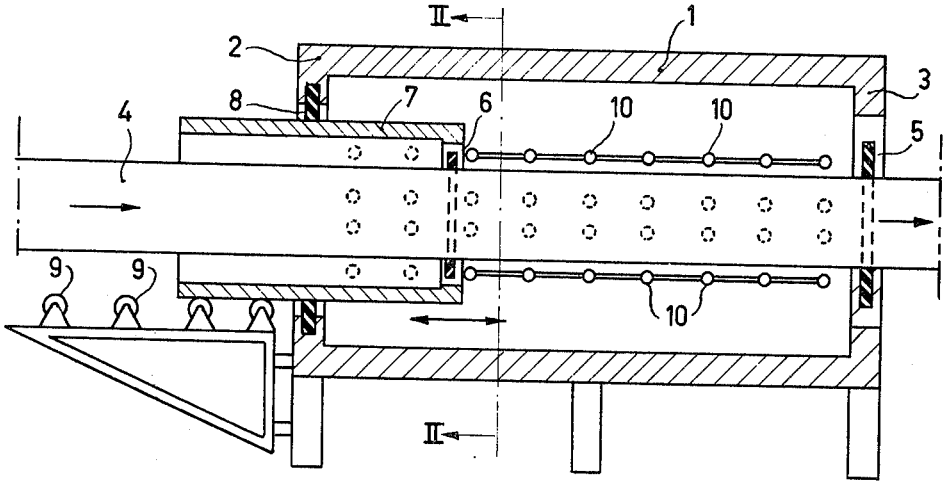
Figure 2:
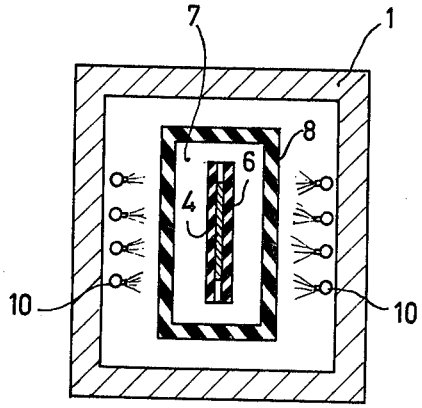

The invention will be described in greater detail with reference to the accompanying drawing, in which:

FIG. 1 is a longitudinal cross-sectional view of an apparatus according to the invention, and FIG. 2 is a cross-sectional view taken on the line II—II of FIG. 1.

The device shown in FIG. 1 comprises an etching compartment 1 consisting of a casing having an inlet end 2 and an outlet end 3, the casing being manufactured from titanium which is not attacked by corrosive etching liquids. The strip 4 to the etched moved through the casing in the direction of the arrows. The inlet end 2 and the outlet end 3 should be readily closable so as to prevent the etching liquid from escaping, and they let pass the strip 4 via rubber closure means 5 and 6. The closure means 5 and 6 are rubber strips which press against the strip 4 on both sides. In known etching apparatus the inlet end is closed in the same manner as the outlet end, so as shown in the drawing at 3 and 5. In the apparatus according to the invention the closure means 6 are present in a houding 7 which is arranged so as to be movable in the etching compartment 1 along the path of movement of the strip 4. The outer circumference of the housing 7 is sealed relative to the etching compartment 1 by means of a rubber member 8. When the housing 7 is slid over the rollers 9 fully to the outside, the etching duration is maximum. The nominal thickness of the strip 4 is 0.150 mm and it may be for example between 0.140 mm and 0.155 mm. Said spread in the thickness of the strip 4 can be compensated for by a movement of the housing over totally 0.60 m. With the nominal strip thickness the length of the etching compartment is approximately 3.20 m.

The strip 4 is disposed in a vertical plane during its passage through the etching compartment 1. Spraying heads 10 which spray etching liquid continuously against the strip 4 are present on both sides of the strip. Immediately after the outlet end 3 the strip is rinsed with water so as to interrupt the etching action as abruptly as possible. This is also the reason why the housing 7 is preferably present on the inlet end 2. In fact, should the housing 7 be present on the outlet end 3, then the strip could be rinsed only after having passed outaide the housing, unless it had already been rinsed inside the housing.

FIG. 2 is a cross-sectional view of the apparatus taken on the line II—II of FIG. 1. Corresponding components in this Figure are referred to by the same reference numerals as in FIG. 1.

The construction of the etching apparatus is otherwise the same as that known from the prior art. Conventional etching liquids may be used and the conventional materials may be etched in the apparatus.

What is claimed is:

1. An apparatus for etching a continuously moving thin metal strip, comprising an etching compartment in which spraying heads for etching liquid are arranged along the length of the etching compartment, said compartment being closed on the inlet end and on the outlet end by means of closure means pressing against both main surfaces of the strip, said closure means on at least one of the two ends being arranged in a housing which is movable in the etching compartment along the path of movement of the metal strip, and the housing being sealed on the outside relative to the etching compartment.

2. An apparatus as claimed in claim 1, characterized in that the movable housing is present at the inlet end of the etching compartment.

3. An apparatus as claimed in claim 1 wherein the housing is moved further into the etching compartment according as the thickness of the strip is smaller.

* * * * *